US005662059A

United States Patent [19]

Franzen et al.

[11] Patent Number: 5,662,059

[45] Date of Patent: Sep. 2, 1997

[54] DEVICE FOR COVERING A SHIP'S HATCH OR SIMILAR LOADING OPENING

[75] Inventors: Hermann Franzen, Mönchengladbach; Janis Moutsokapas, Monheim, both of Germany

[73] Assignee: Mannesmann Aktiengesellschaft, Düsseldorf, Germany

[21] Appl. No.: 602,162

[22] Filed: Feb. 15, 1996

[30] Foreign Application Priority Data

May 22, 1995 [DE] Germany ..... 195 19 283.4

[51] Int. Cl.[6] ..... B63B 19/14

[52] U.S. Cl. ..... 114/201 R; 414/137.4

[58] Field of Search ..... 114/201 R; 414/137.4; 135/90

[56] References Cited

U.S. PATENT DOCUMENTS 3,348,705 10/1967 Yanow ..... 414/137.4
3,405,814 10/1968 Yanow ..... 114/201 R

FOREIGN PATENT DOCUMENTS 44 47 386 A1 6/1996 Germany .
1576143 7/1990 U.S.S.R. ..... 114/201 R
93009995 5/1993 WIPO ..... 114/201 R

*Primary Examiner*—Sherman Basinger
*Attorney, Agent, or Firm*—Cohen, Pontani, Lieberman & Pavane

[57] ABSTRACT

A device for covering a ship's hatch by a loading chute which can be placed on the edge of the hatch during loading and unloading of a pallet container which is attached to a load suspension apparatus. The loading chute can be automatically opened and closed as a function of the position of the pallet container. The upper opening of the chute can be covered, when the rain-protected pallet container is in the loading shaft or below it, by an umbrella-like shield which is arranged on the load suspension apparatus above the pallet container. A rolling gate in one end position closes the loading opening and after covering of the upper opening of the loading chute by the shield, can be moved into another end position which flees the loading opening. The opening and closing movements of the rolling gate are controlled by contact-less transmitters which detect the position of the pallet container in the chute.

5 Claims, 3 Drawing Sheets

DEVICE FOR COVERING A SHIP'S HATCH OR SIMILAR LOADING OPENING

BACKGROUND OF THE INVENTION

1. Field of the Invention

The present invention relates to a device for covering a ship's hatch or similar loading opening with a loading shaft which can be placed on the edge of the opening during loading and unloading of a pallet container attached to a load suspension apparatus, such as port mobile crane and pallet loader. The loading shaft is adapted to be opened and closed automatically as a function of the position of the load suspension apparatus and the upper opening of the shaft is adapted, when a rain-protected pallet container is present in the loading shaft or below it, to be covered by an umbrella-like shield arranged on the load suspension apparatus above the pallet container.

2. Description of the Prior Art

A device of the above-described type is described in German patent application P 44 47 386.6 filed Dec. 22, 1994, and published Jun. 27, 1994. This device permits the loading and unloading of ships, particularly with paletted cargo, regardless of the weather. Upon the unloading of moisture-sensitive cargoes or upon the loading of such goods into ships, delays frequently occur because of the weather, thus leading to longer ship lay times, which not only delay the transportation of the goods but also considerably increase the expense thereof as a result of high additional demurrage. It has therefore been attempted on various occasions to make loading and unloading possible even in poor weather, and particularly heavy rain, by preventing the water from entering into the stowage space. This was accomplished in the past by a shaft which is open on one side, is placed over the loading opening of the ship and, placed on the edge thereof, forms a housing that has a top that can be closed by overlapping covers. The upper cover can be temporarily pushed aside by the pallet containers or articles suspended from the load suspension apparatus to permit the passage of the hoisting cables, without large mounts of water being able to penetrate. The loading shaft itself can be placed on or removed by the existing crane and thus be used on different ships as long as the dimensions of the loading shaft correspond substantially to the dimensions of the loading openings.

Due to the fact that the two-piece overlapping of the upper opening of the shaft is opened mechanically by friction lock by the horizontal movement of the load suspension apparatus and by the load suspension apparatus itself, there is the danger—particularly in the case of a large pendulum length of the hoisting cable—of the pallet container tilting. This is disadvantageous, particularly upon the loading of a ship, when the loading is effected automatically since, due to the unintended oblique position of the pallet containers, orderly loading is no longer possible.

SUMMARY OF THE INVENTION

Accordingly, it is an object of the present invention to provide a covering device in which, regardless of the movement of the load suspension apparatus, the position of the pallet container is detected without contact and the opening and closing of the cover is controlled as a function thereof. It is a further object to provide a device for covering the loading opening that is capable of being used for a large number of different size loading openings; i.e. it is adaptable to the loading hatches of different ships.

Pursuant to this object, one aspect of the present invention resides in a rolling gate provided for opening and closing the loading opening. The rolling gate closes the loading opening in one of its end positions. After the upper opening of the loading chute has been covered by the shield, the gate can be moved into a different end position which frees the loading opening. The opening and closing movements of the rolling gate are preferably controlled by contactless transmitters which detect the position of the pallet container.

In contradistinction to the known devices, in the present invention the opening and closing of the loading opening is no longer effected mechanically by the load suspension apparatus or the pallet container itself, but rather is effected independently without contact. An oblique position of the pallet container, even with large pendulum length of the hoisting cables is definitely avoided, so that undisturbed loading and unloading is possible. The rolling gate is separately driven, moved, and brought to the place corresponding to the position of the pallet container. Since the rolling gate cooperates with the umbrella-like shield which is arranged above the pallet container, it is possible for the opening of the rolling gate to be adjusted, after the introduction of the pallet container into the loading chute, so that the shield first substantially closes off the upper opening of the chute before the rolling gate frees the loading opening. In this way, it is assured that the loading hatch is always protected from weather conditions such as snow or rain, and that all processes can take place in an automated fashion.

The rolling gate is preferably guided in its two end positions within the loading chute, so that the loading chute together with the rolling gate and drive can be placed as a structural unit—transported by crane—onto the loading opening of the ship.

In one embodiment of the invention, the rolling gate is guided on both sides of the loading opening on endlessly rotating toothed belts which move the rolling gate, depending on the direction of movement of the toothed belts, into one or the other of the end positions. The region between the endless revolving toothed belts remains free in order to permit loading.

In order to allow the loading chute to be placed on the largest possible number of ships of different size, even if the width of the loading chute is less than the width of the loading opening, in another embodiment of the invention, the loading chute is arranged on a base which is adjustable to the width and height of the loading opening. In the case of a smaller width of the loading chute than the width of the loading opening, the base covers the remaining open gap. In this way, the rolling gate and chute can be dimensioned in a manner corresponding in each case to the dimensions of the pallet container, while, due to the displaceable base, adaptation to different measurements can be effected on the spot. In this connection, it is particularly the width of the loading opening which is to be taken into account, while the length of the loading openings can as a rule be covered by the hatches present on the ship.

In a further embodiment, the base consists of horizontal support beams of adjustable length. The free ends of the support beams can be placed on the edge of the loading opening and cooperate with a protective covering (roller shade) for the gap which is unrolled upon the extending support beams. With this construction, when the support beams are adjusted to the width of the loading opening, rain protective covers are unrolled automatically in the manner of an awning and pulled over the remaining loading opening so that no water can enter into the loading hatch. This solution is simple and functional and permits great flexibility of the device in accordance with the invention.

In another embodiment of the invention, in the case of a laterally approached loading chute, the loading chute is U-shaped with an open side wall, which, when the loading opening is open, can be dosed by the rolling gate moved into its second end position.

Frequently, it is desired to load and unload the ship from the shore by a lateral approach. The rolling gate in accordance with the invention is able, with suitable lateral guidance, also to represent a suitable protective covering for this, in the manner that, with the pallet container introduced into the chute and covered on top by the shield, the open side wall is protected laterally by the rolling gate, the lower loading opening to the loading hatch being freed at the same time. The loading opening is therefore, with corresponding control of the movement of the rolling gate protected in every position of the pallet container without mechanical devices coupled with the load suspension apparatus or the pallet container having to be provided.

In still a further embodiment, the loading chute is also open on its side opposite the open side wall, and this opening is adapted to be closed by another rolling gate. This use is conceivable if, in addition, loading and unloading from ocean-going vessels to river vessels is to be effected.

The advantage of the inventive device is that it can be easily and inexpensively set up for covering the ship's hatch, and the device is no longer mechanically controlled with respect to its opening or closing movement by the pallet containers or the load suspension means but is controlled as a function of the position of the pallet container in the loading chute, which position is detected without contact. Furthermore, the displaceable base permits the adaptation of the inventive device to different loading openings and it can thus be used on a large number of ships. With corresponding development, lateral approach to the loading opening is possible in the same way as loading through the loading chute for loading and unloading from ocean-going ships to river ships.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
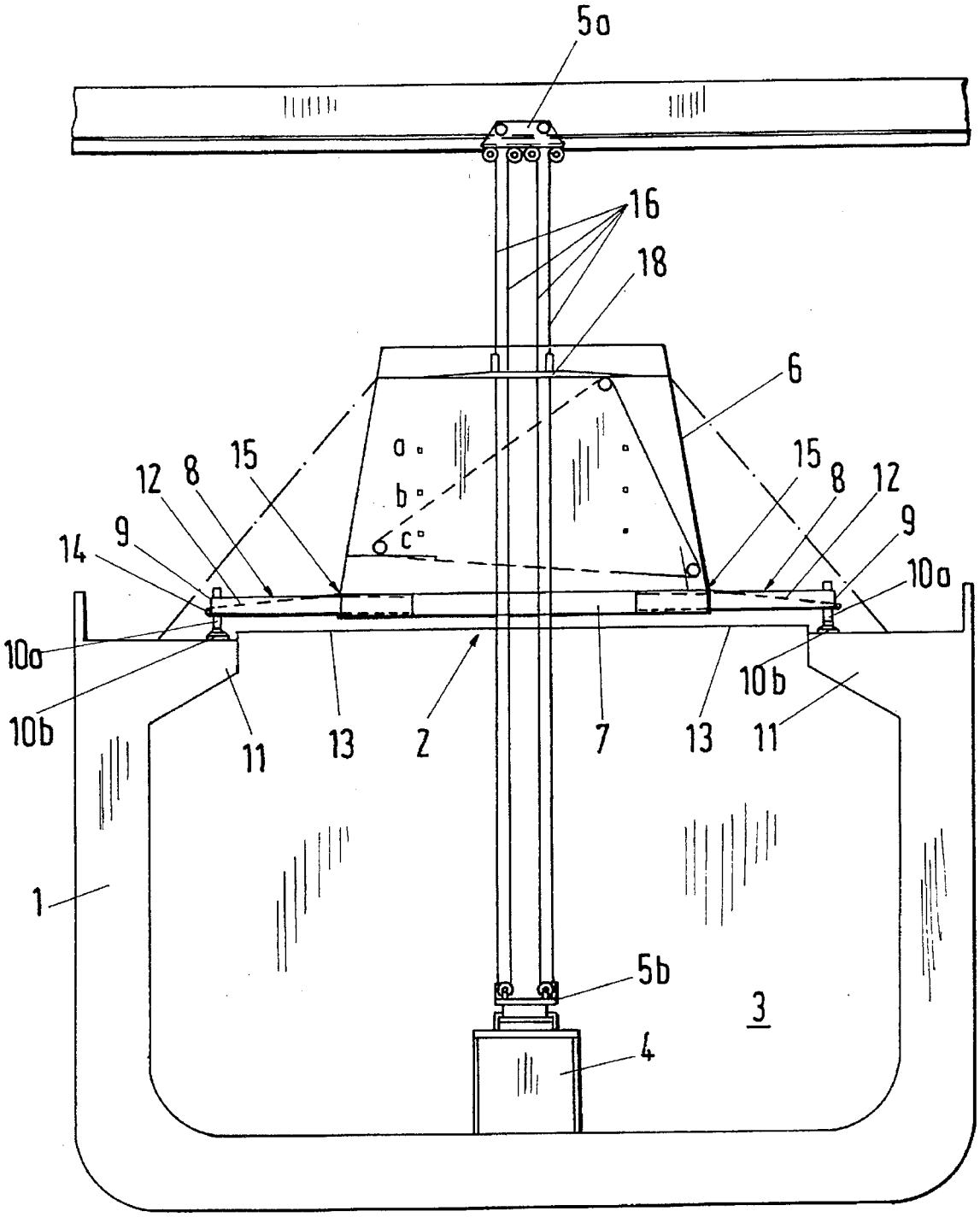
FIG. 1 is a cross section through the body of a ship having the device in accordance with the resent invention, shown with the rolling gate open.

FIG. 1 shows, in rough diagrammatic form, a cross section through a ship 1 which is to be loaded. The cargo hold 3 of the ship 1 is open at the top (loading opening 2) so that rain-protected pallet container 4 can be transported by a crane trolley 5*a* and load suspension means 5*b* to the hold 3. As protection from the weather, the loading opening 2 of the ship's body is closed by the loading chute 6 which has outwardly inclined side walls arranged on a base 7. The base 7 consists of horizontal support beams 8 that are adjustable in length and rest at their free ends 9 via vertical variable-height supports 10*a* and support plates 10*b* on the edge 11 of the loading opening. Between the support beams 8 there is a protective covering 12 which covers the opening gap remaining at 13 on both sides of the loading chute 6. The protective covering 12 is rolled up in the manner of a window shade at 14 and is fastened at 15 in the region of the loading chute so that the protective covering 12 automatically unrolls upon extension of the support beams 8 and covers the opening gap.

The pallet container 4 is attached to the load suspension means 5*b*, and is raiseable and lowerable by cables 16. An umbrella-like shield 18, guided by the cables 16, moves vertically freely between the crane trolley 5*a* and the load suspension means 5*b*, and covers horizontally the upper opening of the chute 6 when the pallet container 4 is in or below the loading chute 6. The shield 18 closes off the top of the loading chute 6 upon the loading of the pallet container 4.

Figure 2:
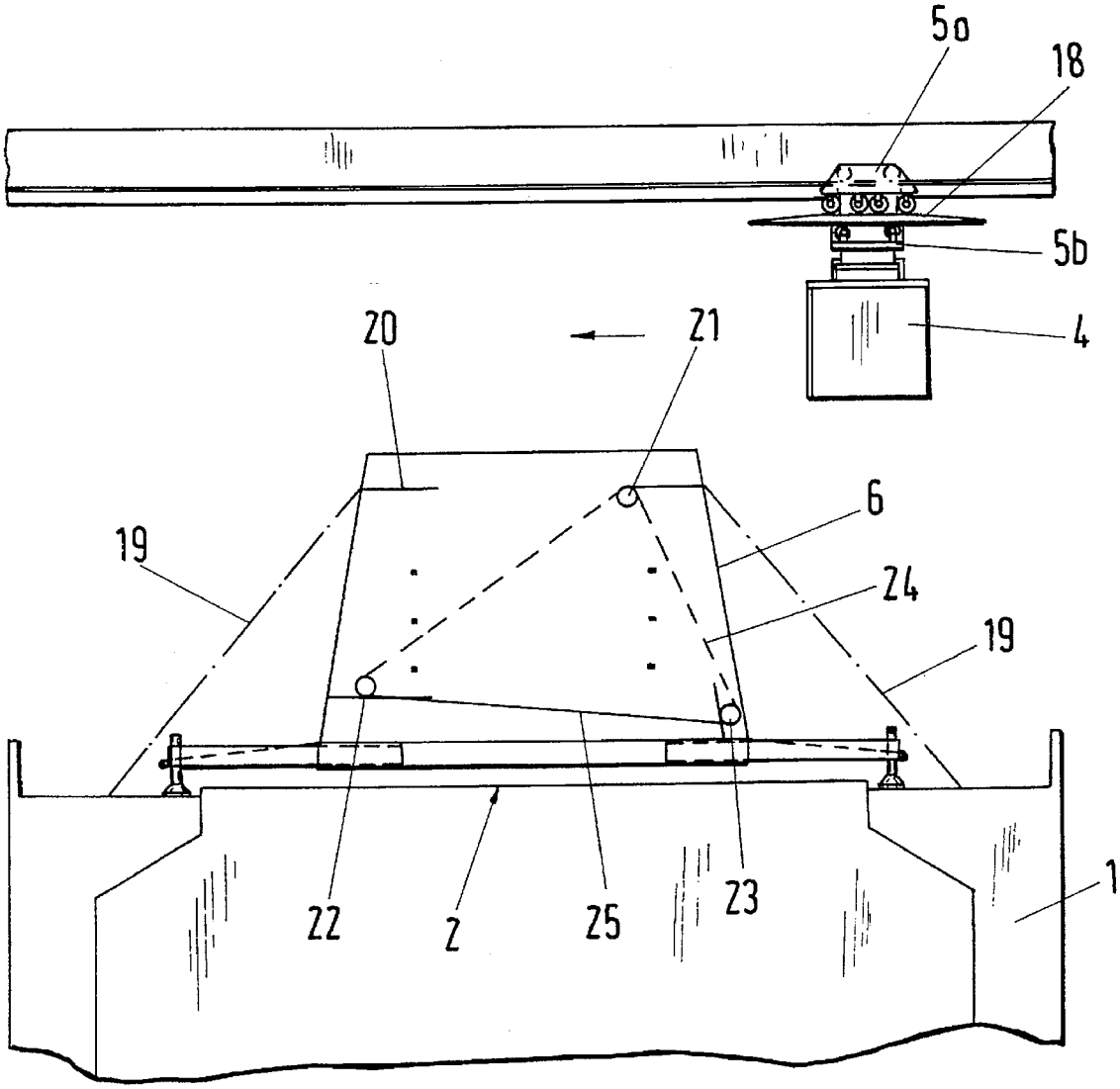
FIG. 2 shows the device of the invention with the rolling gate closed.

As can be better seen in FIG. 2, the loading chute 6 is fastened by bracing wires 19 of variable length to the ship's body 1. The chute has, on its inner side, an annular collar 20 on which the shield 18 can be placed and below which an upper guide pulley 21 of two further guide pulleys 22, 23 is arranged. Endless toothed belts 24 travel around the pulleys 21–23, parallel to each other on both sides of the loading chute 6. The toothed belts 24 guide between each other a deflectable rolling gate 25 which, in the position shown in FIG. 2, closes the loading opening 2 of the ship's body 1. By the oblique arrangement of the rolling gate 25, rain water which has penetrated through the upper chute opening can run out at the side of the chute and be led away. The loading opening 2 is therefore closed in the position shown by the rolling gate 25 as well as the protective covers 12.

As can furthermore be noted from FIG. 1, within the loading chute 6 there are various transmitters, designated a, b and c, which detect the position of the pallet container 4 transported into the loading chute and use the detected position information to control the rolling gate 25.

Figure 3:
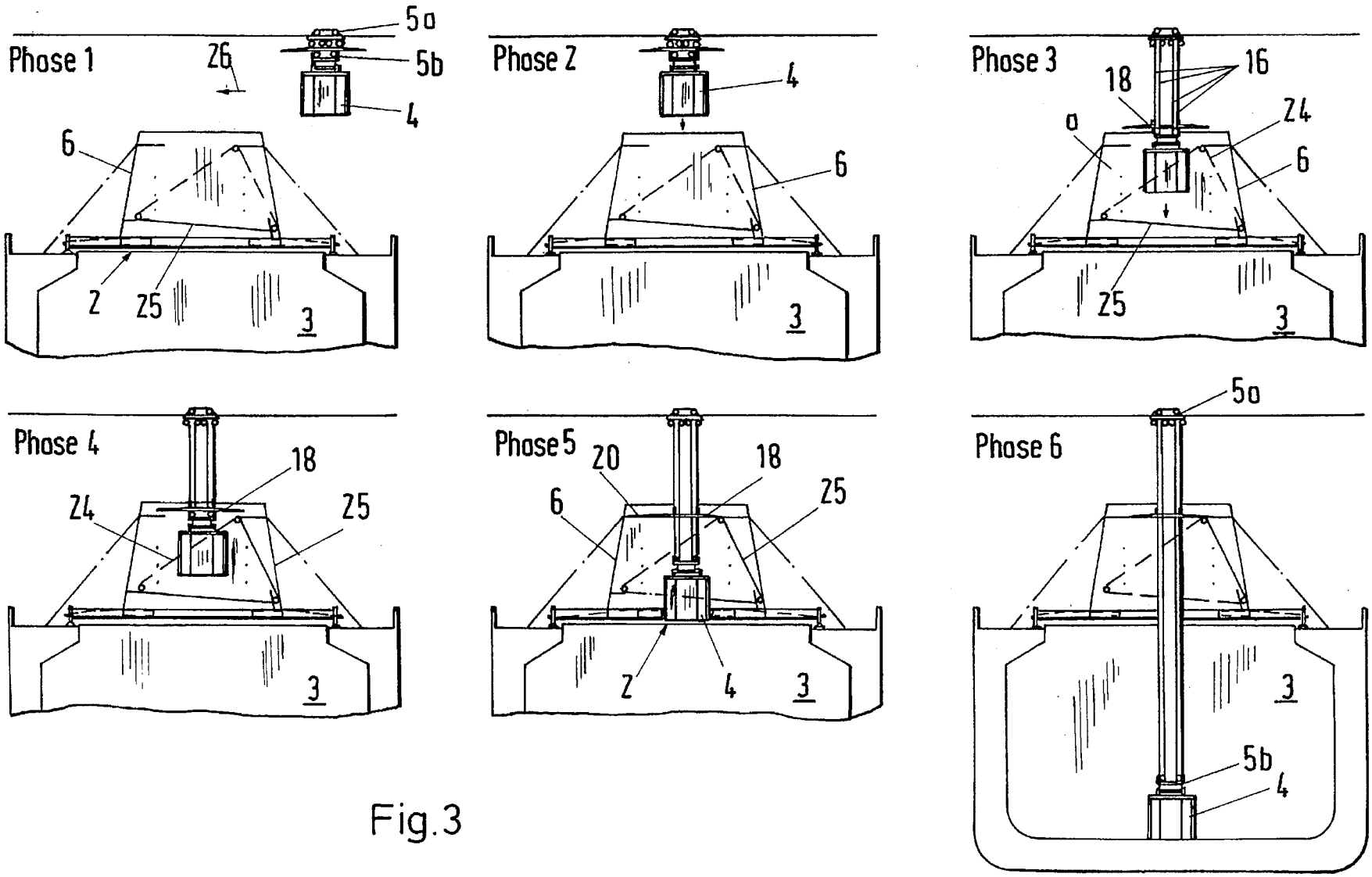
FIG. 3 shows, in six phases, the loading of a ship using the inventive device.

In FIG. 3, the process of loading the hatch 3 is shown in six steps. In the first step (Phase 1), the crane trolley 5*a* and the load suspension means 5*b* transport the pallet container 4 in the direction indicated by the arrow 26. The rolling gate 25 is in its end position and, together with the protective covers 12 (FIG. 2), closes off the loading opening 2. The side walls of the loading chute 6 form a closed housing and any water entering through the upper opening of the shaft discharges laterally over the closed rolling gate 25.

In the second phase shown, the pallet container 4 is in a position above the loading chute 6, while the position of the rolling gate 25 remains unchanged.

In the third phase, by releasing the hoisting cables 16, the pallet container 4 is introduced into the loading chute 6 and has reached the first position detector a. Upon the further lowering of the pallet container 4, the rolling gate 25 starts to open by rotation of the toothed belt 24, while at the same time the shield 18 starts to close the upper opening of the chute. This is shown in phase 4.

In phase 5, the pallet container 4 has been lowered still further. The shield 18 lies on the annular collar 20 of the loading chute 6 and closes it tightly. At the same time, the rolling gate 25 has moved into a position at the side of the loading chute 6, as can be noted on an enlarged scale in FIG. 1. The loading opening 2 is freed so that the pallet container 4 can enter into the cargo hold 3. All openings are closed by the shield 18, the protective covers 12 on both sides of the loading chute 6, and the walls of the loading chute 6 itself. This position is retained until the pallet container 4 (sixth phase) has reached the bottom of the cargo hold 3 and has been loaded or unloaded there by means of fork trucks.

Upon the removal of the pallet container from the cargo hatch, the steps take place in the opposite sequence, the loading opening 2 of the ship's body 1 being so closed in each position so that weather influences cannot damage the cargo.

The invention is not limited by the embodiments described above which are presented as examples only but can be modified in various ways within the scope of protection defined by the appended patent claims.

We claim:

1. A device for covering a ship's loading opening during loading and unloading of a pallet container attached to a load suspension apparatus, comprising:

a loading chute placeable on an edge of the loading opening, and having an upper opening;

a shield attachable to the load suspension apparatus, the shield closing the upper opening of the loading chute when the pallet container is lowered into the loading chute;

a rolling gate connected to the loading chute so as to be movable between a first end position in which the rolling gate covers the loading opening, and a second end position in which the loading opening is uncovered; and means for moving the rolling gate, the moving means including non-contact transmitters arranged in the loading chute to detect position of the pallet container and output a corresponding signal, the moving means moving the rolling gate in response to the signals from the transmitters.

2. A device for covering a ship's loading opening according to claim 1, wherein the rolling gate is arranged within the loading chute.

3. A device for covering a ship's loading opening according to claim 2, wherein, the moving means includes endless toothed belts wrapped around guide pulleys, the rolling gate being supported at its sides by the toothed belts.

4. A device for covering a ship's loading opening according to claim 1, and further comprising a base, the loading chute being arranged on the base, the base being configured to be adjustable to a width and height of the loading opening, the base including means for covering gaps which are present if the loading chute has a width that is less than the width of the loading opening.

5. A device for covering a ship's loading opening according to claim 4, wherein the base includes horizontal support beams of adjustable length which have free ends that are placeable on the edge of the loading opening, the covering means including a shade-like cover member that is attached to the support beams so that adjusting the length of the support beams rolls and unrolls the cover member so that the cover member covers the gap between the loading chute and the edge of the loading opening.

* * * * *